US009213291B2

(12) United States Patent
Ozaki

(10) Patent No.: US 9,213,291 B2
(45) Date of Patent: Dec. 15, 2015

(54) CONTROL SYSTEM FOR FORMING IMAGE, IMAGE FORMING APPARATUS, IMAGE FORMING APPARATUS CONTROL METHOD, AND RECORDING MEDIUM STORING IMAGE FORMING APPARATUS CONTROL PROGRAM

(71) Applicant: Yusuke Ozaki, Tokyo (JP)

(72) Inventor: Yusuke Ozaki, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/168,197

(22) Filed: Jan. 30, 2014

(65) Prior Publication Data

US 2014/0233999 A1 Aug. 21, 2014

(30) Foreign Application Priority Data

Feb. 21, 2013 (JP) ..... 2013-032276

(51) Int. Cl.
*G03G 15/00* (2006.01)
*B65H 7/02* (2006.01)

(52) U.S. Cl.
CPC .. *G03G 15/5029* (2013.01); *G03G 2215/00738* (2013.01); *G03G 2215/0129* (2013.01)

(58) Field of Classification Search
CPC ..... G03G 15/00; G03G 12/00; G03G 21/00; G03G 15/5029; G03G 2215/00738; G03G 2215/0129; B56H 7/02; B65H 5/06
USPC ..... 399/16, 45
See application file for complete search history.

(56) References Cited

U.S. PATENT DOCUMENTS

| | | | | |
|---|---|---|---|---|
| 5,743,521 | A * | 4/1998 | Munakata et al. | 271/263 |
| 6,850,717 | B2 * | 2/2005 | Fujikura et al. | 399/45 |
| 2005/0280205 | A1 * | 12/2005 | Knierim | 271/265.04 |
| 2006/0220305 | A1 * | 10/2006 | Serizawa et al. | 271/262 |
| 2009/0074435 | A1 * | 3/2009 | Murakami | 399/45 |
| 2009/0074436 | A1 * | 3/2009 | Murakami | 399/45 |
| 2009/0136246 | A1 * | 5/2009 | Murakami | 399/45 |
| 2010/0300196 | A1 * | 12/2010 | Ise | 73/159 |
| 2011/0210506 | A1 * | 9/2011 | Yamazaki et al. | 271/265.04 |
| 2012/0228818 | A1 * | 9/2012 | Seki | 271/109 |

FOREIGN PATENT DOCUMENTS

| | | | | |
|---|---|---|---|---|
| JP | 7-215537 | | 8/1995 | |
| JP | 2003-149887 | | 5/2003 | |
| JP | 2008-247612 | | 10/2008 | |
| JP | 2012166913 | A * | 9/2012 | B65H 7/02 |

* cited by examiner

*Primary Examiner* — Nguyen Ha
*Assistant Examiner* — Wyn Ha
(74) *Attorney, Agent, or Firm* — Harness, Dickey & Pierce, P.L.C.

(57) ABSTRACT

A control apparatus for controlling an image forming apparatus that forms and outputs an image on paper, a method of controlling the image forming apparatus, and a program for controlling the image forming apparatus stored on a recording medium are described. The image forming apparatus includes a pair of rollers that sandwich the paper and the center of an axle of at least one of the rollers is displaceable. The control apparatus includes a roller position detection signal generator that generates a detection signal indicating a position of the roller, a roller position detection signal acquisition unit to acquire multiple detection signals in chronological order, a paper thickness calculator to calculate paper thickness based on the multiple detection signals acquired in chronological order, and a vibration detector to detect vibration of the image forming apparatus based on the multiple detection signals acquired in chronological order.

10 Claims, 8 Drawing Sheets

CONTROL SYSTEM FOR FORMING IMAGE, IMAGE FORMING APPARATUS, IMAGE FORMING APPARATUS CONTROL METHOD, AND RECORDING MEDIUM STORING IMAGE FORMING APPARATUS CONTROL PROGRAM

CROSS-REFERENCE TO RELATED APPLICATION

This patent application is based on and claims priority pursuant to 35 U.S.C. §119 to Japanese Patent Application No. 2013-032276, filed on Feb. 21, 2013 in the Japan Patent Office, the entire disclosure of which is hereby incorporated by reference herein.

BACKGROUND

1. Technical Field

The present invention relates to a control system for forming an image, an image forming apparatus, a method of controlling the image forming apparatus, and a recording medium storing a control program for the image forming apparatus.

2. Background Art

With the increasing digitization of information, image processing apparatuses such as printers and facsimiles used for outputting the digitalized information and scanners used for digitalizing documents have become indispensable. In most cases, these image processing apparatuses are configured as multifunctional peripherals (MFPs) that can be used as printers, facsimiles, scanners, or copiers by implementing an image capturing function, image forming function, and communication function, etc.

In these image processing apparatuses, vibration due to disturbance of the apparatus is detected and the detected result is used for controlling various units of the apparatus. A prime example of vibration due to disturbance is vibration caused by user operation of units included in the apparatus along with physical movement of those units.

In image forming apparatuses used for outputting digitalized documents, a technology that detects the paper thickness used as an image recording medium is known (e.g., JP-2008-247612-A and JP-2003-149887-A). The paper thickness is detected by including a pair of rollers that sandwich the sheet of paper and having one roller (hereinafter referred to as "driven roller") displace in the thickness direction of the paper along with the paper thickness as the paper is carried through the rollers. The paper thickness can then be determined by detecting the displacement amount of the roller.

SUMMARY

An example embodiment of the present invention provides a control apparatus for controlling an image forming apparatus that forms and outputs an image on paper. The image forming apparatus includes a pair of rollers that sandwich the paper, with the center of the axle roller of at least one of the rollers being displaceable. The control apparatus includes a roller position detector that generates a detection signal indicating a position of the roller, a roller position detection signal acquisition unit to acquire multiple detection signals in chronological order, a paper thickness calculator to calculate paper thickness based on the multiple detection signals acquired in chronological order, and a vibration detector to detect vibration of the image forming apparatus based on the multiple detection signals acquired in chronological order.

Example embodiments of the present invention include a method of controlling the image forming apparatus executed by the control apparatus for forming an image, and a non-transitory recording medium storing a program that causes a computer to implement the image forming apparatus control method.

BRIEF DESCRIPTION OF THE DRAWINGS

A more complete appreciation of the disclosure and many of the attendant advantages thereof will be readily obtained as the same becomes better understood by reference to the following detailed description when considered in conjunction with the accompanying drawings.

DETAILED DESCRIPTION

Figure 1:
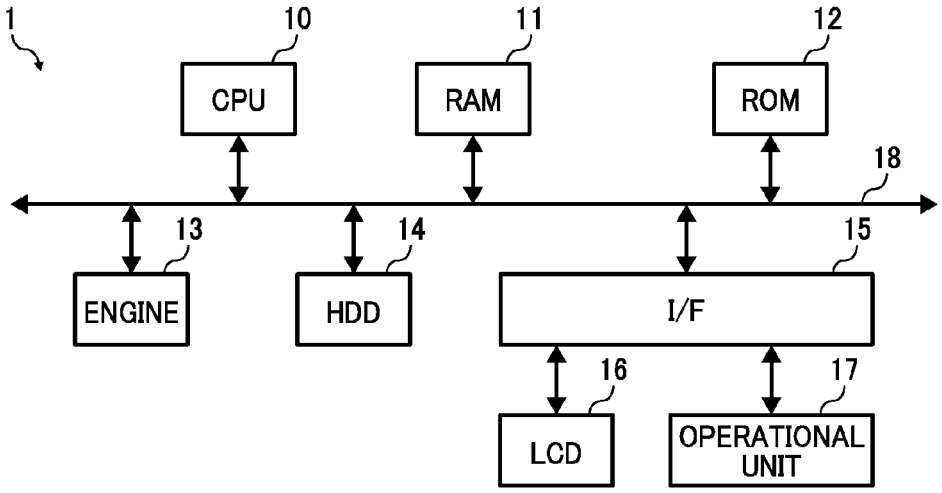
FIG. 1 is a block diagram illustrating a hardware configuration of an image forming apparatus as an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

In an image forming apparatus, the vibration due to disturbance could be detected by including an acceleration sensor in the image forming apparatus for example. However, it may not be preferable to include additional devices such as the acceleration sensor from the viewpoint of saving costs of the image forming apparatus.

As one embodiment of the present invention, in the following embodiment, an apparatus with a simple configuration that can detect disturbance is provided.

More specifically, in the following embodiment, taking an MFP as an image forming apparatus as an example, a technology that detects vibration due to disturbance of an apparatus using a configuration for detecting paper thickness on which an image is formed. In addition, the image forming apparatus is not limited to an MFP but may also be a copier or a facsimile machine, etc., that includes a configuration for forming an image.

FIG. 1 is a block diagram illustrating a hardware configuration of the image processing apparatus. As shown in FIG. 1, an image forming apparatus 1 in this embodiment includes an engine that executes forming an image in addition to a configuration similar to information processing apparatuses such as general servers, and personal computers (PCs). That is, in the image forming apparatus 1 in this embodiment, a Central Processing Unit (CPU) 10, a Random Access Memory (RAM) 11, a Read Only Memory (ROM) 12, an engine 13, a hard disk drive (HDD) 14, and an interface (I/F) 15 are connected with each other via a bus 18. In addition, a Liquid Crystal Display (LCD) 16 and an operational unit 17 are connected to the I/F 15.

The CPU 10 is a processor and controls the whole operation of the image forming apparatus 1. The RAM 11 is a volatile storage device that can read/write information at high speed and is used as a work area when the CPU 10 processes information. The ROM 12 is a read-only nonvolatile storage device and stores programs such as firmware. The engine 13 executes forming an image and scanning paper.

The HDD 14 is a non-volatile storage device that can read/write information and stores the OS, various control programs, and application programs etc. The I/F 15 connects the bus 80 with various hardware and network, etc., and controls them. The LCD 16 is a visual user interface to check status of the information processing apparatus. The operational unit 17 is a user interface such as a keyboard, mouse, various hardware buttons, and touch panel to input information to the information processing apparatus.

In this hardware configuration described above, programs stored in storage devices such as the ROM 12, HDD 14, and optical discs (not shown in figures) are read to the RAM 11, and a software controlling unit is constructed by executing operation in accordance with the programs by the CPU 10. Functional blocks that implement functions of apparatuses that consist of the image processing system of this embodiment are constructed by a combination of the software controlling unit described above and hardware.

Figure 2:
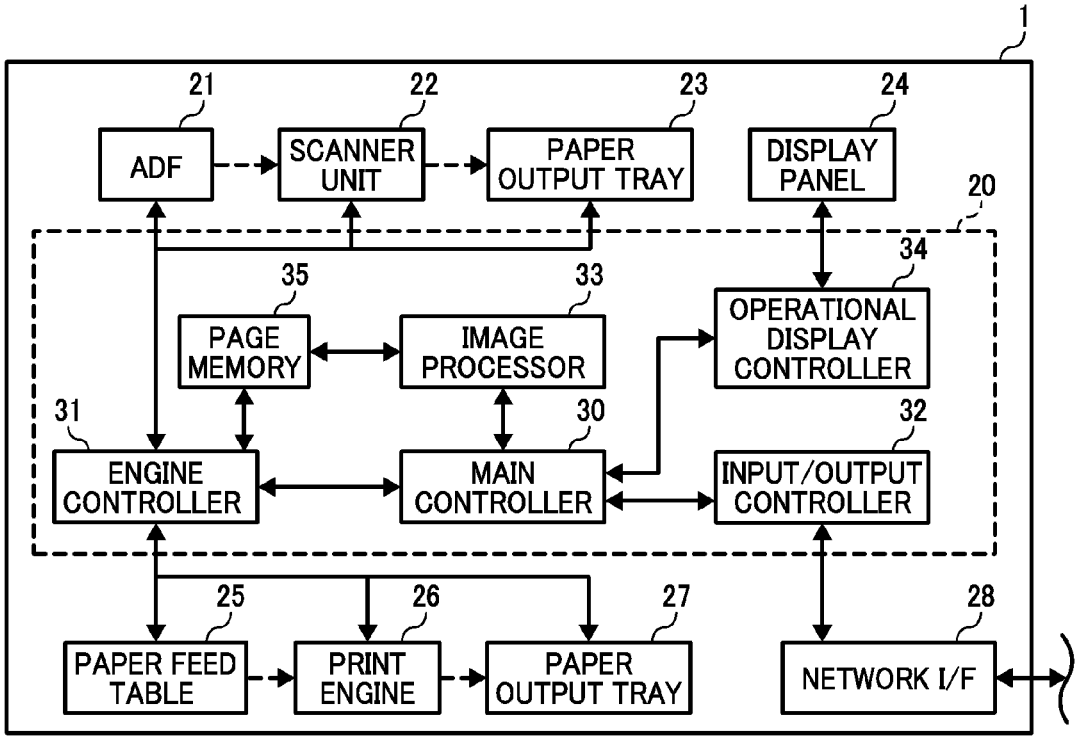
FIG. 2 is a block diagram illustrating a functional configuration of the image forming apparatus.

Next, functions of the image forming apparatus 1 in this embodiment are described below with reference to FIG. 2. FIG. 2 is a block diagram illustrating a functional configuration of the image processing apparatus 1. As shown in FIG. 2, the image processing apparatus 1 includes a controller 20, an Auto Document Feeder (ADF) 21, a scanner unit 22, a paper output tray 23, a display panel 24, a paper feed table 25, a print engine 26, a paper output tray 27, and a network I/F 28.

The controller 20 includes a main controller 30, an engine controller 31, an input/output controller 32, an image processor 33, an operational display controller 34, and a page memory 35. As shown in FIG. 2, the image forming apparatus 1 in this embodiment is constructed as the MFP that includes the scanner unit 22 and the print engine 26. In FIG. 2, solid arrows indicate electrical connections, and dashed arrows indicate flow of paper.

The display panel 24 is both an output interface that displays status of the image forming apparatus 1 visually and an input interface (operational unit) to operate the image forming apparatus 1 directly or input information to the image forming apparatus 1. The network I/F 28 is an interface with which the image forming apparatus 1 communicates with other apparatuses via the network, and Ethernet and Universal Serial Bus (USB) I/F are used as the network I/F 28.

The controller 20 is constructed by a combination of software and hardware. In particular, control programs such as firmware stored in nonvolatile storage devices such as the ROM 12 and the HDD 14 are loaded into the RAM 11, and the software controlling unit is implemented by executing operation by the CPU 10 in accordance with the programs. The controller 20 is constructed of the software controlling unit and hardware such as integrated circuits. The controller 20 functions as a controller that controls the whole part of the image forming apparatus 1.

The main controller 30 controls each unit included in the controller 20 and commands each unit in the controller 20. The engine controller 31 controls and drives the print engine 26 and the scanner unit 22. The input/output controller 32 inputs signals and commands input via the network OF 28 to the main controller 30. In addition, the main controller 30 controls the input/output controller 32 and accesses other apparatuses via the network I/F 28.

The image processor 33 generates drawing information based on print information included in the input print job and stores the generated drawing information in the page memory 35 under the control of the main controller 30. The drawing information is information that the print engine 26 as an image forming unit draws an image to be formed in an image forming operation, and the drawing information is bitmap data that indicates each pixel that consists of the image to be output, that is, pixel information. The print information included in the print job is image information converted to format that the image forming apparatus 1 can recognize by a printer driver installed on an information processing apparatus such as the PC. As described above, the controller 20 including the image processor 33 functions as a pixel information generation controller.

The operational display controller 34 displays information on the display panel 24 and reports information input via the display panel to the main controller 30. The page memory 35 stores the drawing information that corresponds to one page to input the drawing information stably when the engine controller 31 controls the print engine 26 and instructs the print engine 26 to execute forming and outputting an image. The engine controller 31 inputs the drawing information stored in the page memory 35 into the print engine 26 and instructs the print engine 26 to execute forming and outputting an image.

Figure 3:
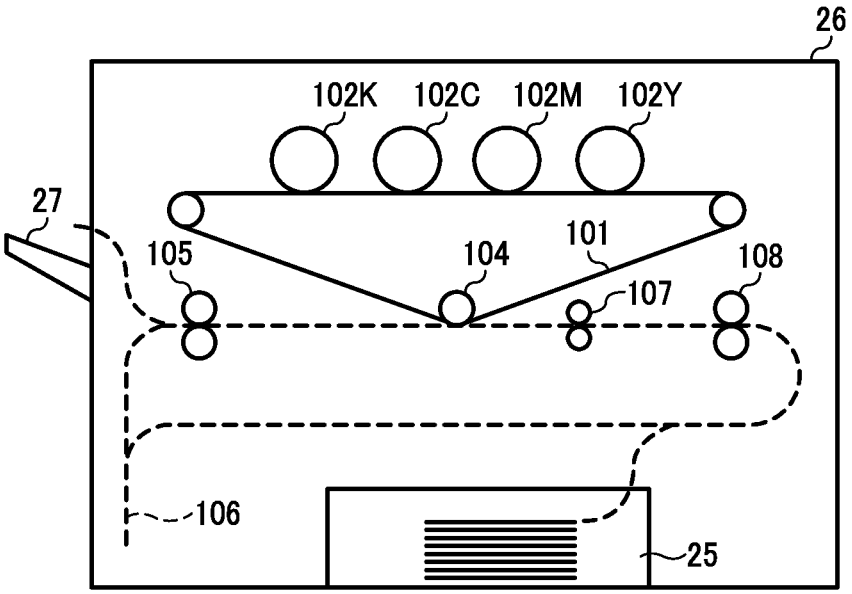
FIG. 3 is a diagram illustrating a configuration of a print engine of the image forming apparatus.

Next, a configuration of the paper feed table 25, the print engine 26, and the paper output tray 27 in this embodiment is described below with reference to FIG. 3. As shown in FIG. 3, In the print engine 26 in this embodiment, photoconductor drums 102Y, 102M, 102C, and 102K (hereinafter referred to as photoconductor drum 102 as a whole) for each color are laid out along with a transfer belt 101 as an endless moving member, and that configuration is so-called tandem type.

As shown in FIG. 3, along with the transfer belt 101 as an intermediate transfer belt on which an intermediate transfer image transferred to paper (an example of recording medium) fed from the paper feed table 25 is formed, multiple photoconductor drums 102Y, 102M, 102C, and 102K are laid out sequentially from the upstream side in the transferring direction of the transfer belt 101.

A full-color image is formed by imposing and transferring the image for each color developed on the surface of the photoconductor drum 102 for each color by toner on the transfer belt 101. The full-color image formed on the transfer belt 101 as described above is transferred to the surface of paper carried through the path at the point where the transfer belt 101 most approaches the paper carrying path shown with the dashed line in FIG. 3 by using a transfer roller 104.

After being fed from the paper feed table 25, the paper on which the image is transferred is carried to the point where the image is transferred as described above waiting for the right timing on a registration roller 107. After forming the image on the paper, the paper is further carried and ejected on the paper output tray after fixing the image by a fixing roller 105. In case of duplex printing, the paper that the image is formed and fixed on one surface is carried to a reversing path 106, and carried to the transferring point of the transfer roller 104 again via the registration roller 107 after being reversed.

The print engine 26 in this embodiment includes a paper thickness detection roller 108 on the carrying path between the paper feed table 25 and the registration roller 107, and paper thickness is detected by the paper thickness detection roller 108. The paper thickness detected by the paper thickness detection roller 108 used for detecting double-sheet feeding and controlling the transfer roller 104 and the fixing roller 105 in accordance with the paper thickness. Furthermore, the image forming apparatus 1 in this embodiment detects vibration due to disturbance based on the detection result of the paper thickness detection roller 108, and that is one of the key points in this embodiment.

The print engine 26 that includes the configuration described above includes another module for processing information such as the CPU 10 and the RAM 11 etc. shown in FIG. 1 separately from the main unit of the image forming apparatus 1. The controller consisted of those modules inside the print engine 26 performs controlling each unit in the print engine 26 shown in FIG. 3 in detail under the control of the engine controller 31. The controller inside the print engine 26 functions as an image forming controlling unit in this embodiment.

If the image forming apparatus 1 operates as a printer, first, the input/output controller 32 receives a print job via the network I/F 28. The input/output controller 32 transfers the received print job to the main controller 30. After receiving the print job, the main controller 30 controls the image processor 33 and instructs the image processor 33 to generate drawing information based on print information included in the print job.

After the drawing information is generated by the image processor 33 and stored in the page memory 35, the engine controller 31 inputs the drawing information to the print engine 26 and performs forming an image on paper carried from the paper feed table 25 by controlling the paper feed table 25 and the print engine 26. After the image is formed on the paper by the print engine 26, the paper is ejected on the paper output tray 27.

If the image forming apparatus 1 operates as a scanner, either the operational display controller 34 or the input/output controller 32 transfers a signal to execute scanning to the main controller 30 in accordance with either user operation on the display panel 24 or a command to execute scanning input from an external PC etc. via the network I/F 28. The main controller 30 controls the engine controller 31 based on the received signal to execute scanning.

The engine controller 31 drives the ADF 21 and carries a document to be scanned set on the ADF 21 to the scanner unit 22. Subsequently, the engine controller 31 drives the scanner unit 22 and scans the document carried from the ADF 21. If the document is set on the scanner unit 22 directly instead of being set on the ADF 21, the scanner unit 22 scans the set document under the control of the engine controller 31. That is, the scanner unit 22 functions as an image pickup unit.

In the image scanning operation, an image pickup device such as CCD included in the scanner unit 22 scans the document optically, and image pickup information is generated based on optical information. The engine controller 31 transfers the image pickup information generated by the scanner unit 22 to the image processor 33. The image processor 33 generates image information based on the image pickup information received from the engine controller 31 under the control of the main controller 30.

In the controller 20, the page memory 35 can be used as a storage area to store the image pickup information. The image information generated by the image processor 33 is either stored in a storage device attached to the image forming apparatus 1 such as the HDD 14 etc. or transferred to an external apparatus via either the input/output controller 32 or the network OF 28.

If the image forming apparatus 1 operates as a copier or a facsimile, the image pickup information that the engine controller 31 received from either the scanner unit 22 or the facsimile interface is stored in the page memory 35 as the drawing information, and the engine controller 31 drives the print engine 26 based on the drawing information just like the printer operation. In addition, an image processing function provided by the image processor 33 can be used in the copy operation and the facsimile operation.

Figure 4A:
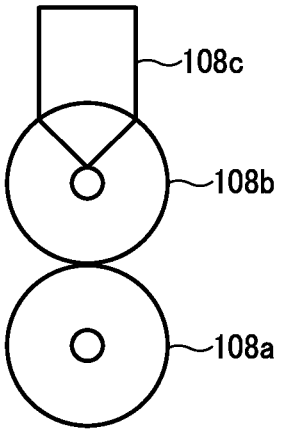
FIGS. 4A and 4B are diagrams illustrating a configuration of paper thickness detection rollers.
Figure 4B:
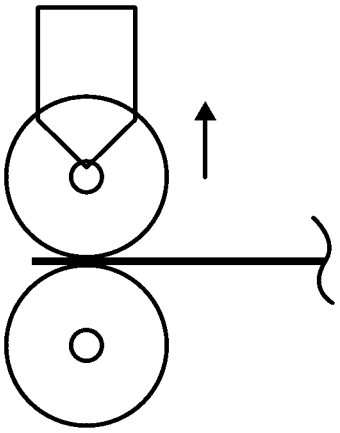

In the configuration described above, to detect vibration due to disturbance by the paper thickness detection roller 108 is the key point in this embodiment. First, the paper thickness detection roller 108 is described with reference to FIGS. 4A and 4B. FIG. 4 is a diagram illustrating a configuration of paper thickness detection rollers 108 in this embodiment. As shown in FIG. 4A, the paper thickness detection roller 108 in this embodiment includes a supporting roller 108*a*, a driven roller 108*b*, and a driven detection sensor 108*c*.

The center of axle of the supporting roller 108*a* is fixed, and the supporting roller 108*a* supports and carries the paper in the carrying path shown in FIG. 3 under the control of the controller in the print engine 26 (hereinafter referred to as "intra-engine controller"). The center of axle of the driven roller 108 is displaceable away from the supporting roller 108*a*. The supporting roller 108*a* and the driven roller 108*b* consist of the pair of rollers.

The driven detection sensor 108*c* detects shift of the center of axle of the driven roller 108*b* and outputs a signal periodically in accordance with the shift amount. The signal output by the driven detection sensor 108*c* is input into the intra-engine controller described above. In other words, the driven detection sensor 108*c* outputs the signal that detects the position of the driven roller 108*b*. That is, the driven detection sensor 108*c* functions as a roller position detector, and the intra-engine controller functions as a roller position detection signal acquisition unit.

If the paper carried through the carrying path enters into the pair of rollers consisted of the supporting roller 108*a* and the driven roller 108*b*, the driven roller 108*b* is brought up in accordance with the paper thickness. The center of axle of the driven roller 108*b* shifts as the driven roller 108 is brought up, and the driven detection sensor 108*c* outputs the detection signal in accordance with the shift amount. Consequently, the print engine 26 acquires the detection signal output by the driven detection sensor 108*c*.

Figure 5:
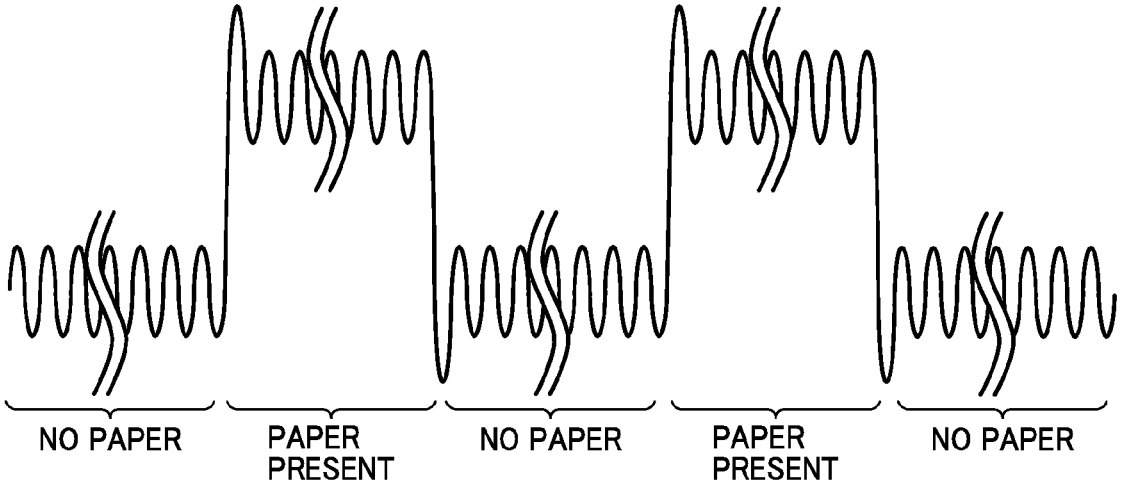
FIG. 5 is a diagram illustrating a driven detection signal.

FIG. 5 is a diagram illustrating a time-series graph of the detection signal output by the driven detection sensor 108*c*. Since a general roller has eccentric component, the detection signal that the driven detection sensor 108*c* outputs includes frequency component shown in FIG. 5 even the supporting roller 108*a* and the driven roller 108*b* simply rotates. The frequency component is defined by rotation period of the supporting roller 108*a* and the driven roller 108*b*.

As shown in FIG. 5, level of the detection signal output by the driven detection sensor 108*c* differs between the state of "no paper" in which the paper is not sandwiched in the pair of rollers of the paper thickness detection rollers 108 and the state of "paper present" in which the paper is sandwiched. This is because the driven roller 108*b* is brought up in accordance with the paper thickness, and the detection signal output by the driven detection sensor 108*c* changes along with that as described above. In other words, the detection signal of the driven detection sensor 108*c* shifts. The intra-engine controller detects the paper thickness based on the signal shift described above.

The intra-engine controller calculates the paper thickness based on average of the detection signal output by the driven detection sensor 108*c* shown in FIG. 5. As shown in FIG. 5, the signal overshoots in shifting from "no paper " to "paper present" and from "paper present" to "no paper". This is because of momentum when the paper enters into the pair of rollers and the paper exits from the pair of rollers. The intra-engine controller calculates the paper thickness ignoring the overshoot described above by selecting the detection signal output by the driven detection sensor 108*c* at predetermined period of time.

Figure 6:
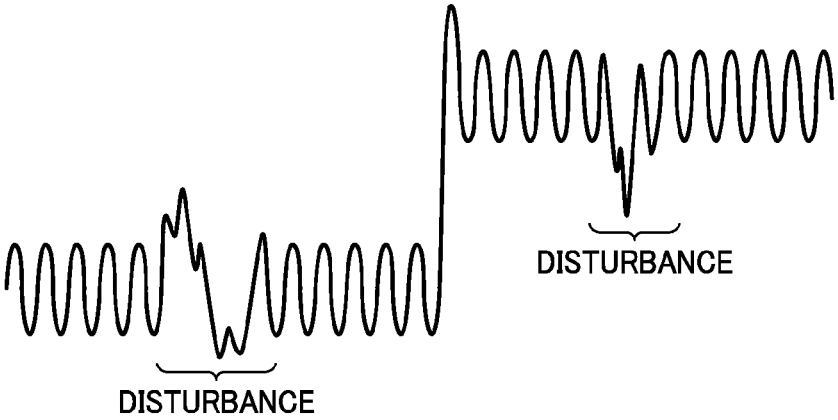
FIG. 6 is a diagram illustrating disturbance.

Here, since the driven roller 108*b* is supported so that the center of axle is displaceable, the center of axle can be moved not only due to the eccentric component of the roller and the paper thickness but also in case of generating vibration due to disturbance. Consequently, the vibration component due to disturbance is output as the detection signal by the driven detection sensor 108*c*. FIG. 6 is a diagram illustrating a graph of the detection signal by the driven detection sensor 108*c* that includes vibration component due to disturbance as described above.

As shown in FIG. 6, if disturbance occurs on the apparatus, the waveform defined by the rotation period of the supporting roller 108*a* and the driven roller 108*b* gets out of order. If the paper thickness is calculated based on the detection signal, the paper thickness is not calculated correctly. On the other hand, if the disturbed waveform is detected, it is possible to detect that disturbance occurs on the apparatus. In other words, it is possible to detect disturbance by acquiring and analyzing multiple detection signals of the position of the center of axle of the driven roller 108*b*.

Figure 7:
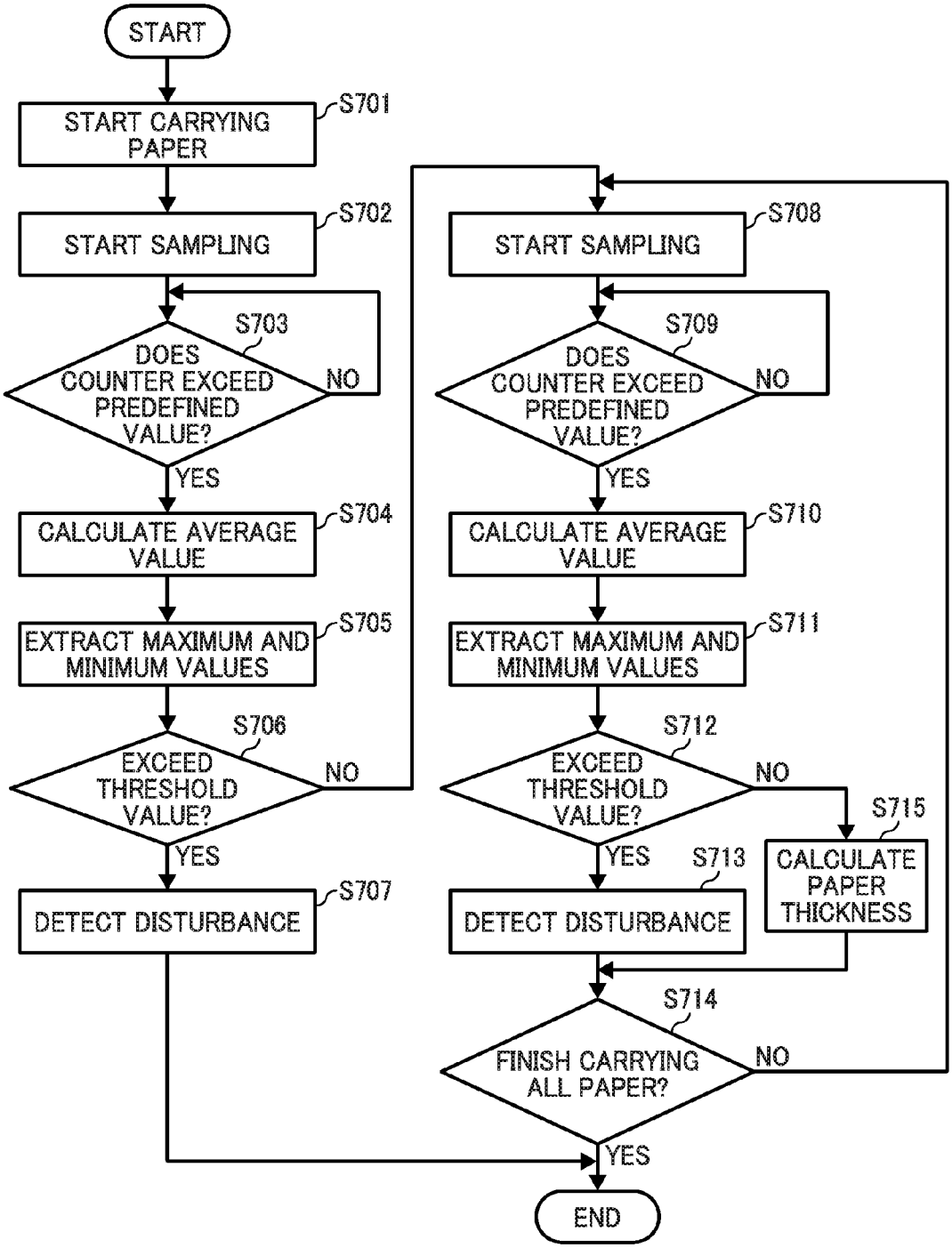
FIG. 7 is a flowchart illustrating a process of detecting paper thickness.

The intra-engine controller in this embodiment performs detecting disturbance as a part of the paper thickness detecting operation based on the detection signal by the driven detection sensor 108*c* described above. The paper thickness detecting operation in this embodiment is described below with reference to FIG. 7. As shown in FIG. 7, after starting carrying paper from the paper feed table 25 under the control of the engine controller 31 in the controller 20 in S701, the intra-engine controller starts sampling the detection signal of the driven detection sensor 108*c* (hereinafter referred to as "driven detection signal") in S702. The driven detection signal is sampled by storing the detection signal output by the driven detection sensor 108*c* in a storage device at a predetermined sampling period.

After starting carrying the paper in S701, the intra-engine controller starts counting to determine each period of "no paper" and "paper present" shown in FIG. 5 and shift timing of the detection signal. If the predetermined period of time is counted (YES in S703), the intra-engine controller calculates average of the driven detection signals that have been sampled until that point in S704. The calculated average is stored as a value at a period in which the paper thickness detection roller 108 does not sandwich the paper, that is, the "no paper" period shown in FIG. 5.

Next, the intra-engine controller extracts the maximum and minimum values of the sampled driven detection signal in S705 and determines whether or not the difference between the extracted maximum value and the minimum value exceeds a predetermined threshold value in S706. In S706, the intra-engine controller determines whether or not the difference between the maximum and minimum value exceeds a threshold value of predetermined upper limit and lower limit. For example, this threshold value can be defined by the eccentric component of the supporting roller 108*a* and the driven roller 108*b* shown in FIG. 5. Alternatively, it is possible to determine whether or not each of the maximum and minimum values exceeds the predetermined upper limit or lower limit.

After determining in S706, if the maximum and minimum values exceed the predetermined threshold value (YES in S706), the intra-engine controller detects that the disturbance occurs as shown in FIG. 6 in S707. That is, the intra-engine controller functions as a vibration detector that detects vibration due to disturbance. If disturbance is detected in S707, that means that the average during the "no paper" period as the standard to detect the paper thickness could not be acquired correctly. Therefore, the intra-engine controller determines that it is impossible to detect the paper thickness in carrying the paper this time and finishes the paper thickness detecting operation Alternatively, after determining in S706, if the maximum and minimum values fall within the predetermined threshold values (NO in S706), the intra-engine controller starts sampling the driven detection signal during the "paper present" period after the "no paper" period at predetermined timing in S708. If the count value to determine the "paper present" period is counted (YES in S709), the intra-engine controller calculates the average of the driven detection signal during that period in S710 just like in S704. The calculated average is stored as value at period in which the paper goes through the paper thickness detection roller 108, that is, the "paper present" period shown in FIG. 5. It is possible to determine "no paper" in S703 and "paper present" in S709 not only by using counting but also by using detection result by a sensor.

Next, the intra-engine controller extracts the maximum and minimum values of the sampled driven detection signals in S711 and determines whether or not the extracted maximum and minimum values exceed the predetermined threshold values in S712 just like in S705. After determining in S712, if the difference between the maximum and minimum values exceeds the predetermined threshold value (YES in S712), the intra-engine controller detects that disturbance occurs in S713 just like in S706. In this case, since sampled values during that period are incorrect, it is canceled to calculate the paper thickness for that page.

Alternatively, after determining in S712, if the maximum and minimum values fall within the predetermined threshold values (NO in S712), the intra-engine controller calculates the paper thickness of the page by subtracting the average calculated in S704 from the average calculated in S710 in S715. Consequently, the intra-engine controller acquires the paper thickness of the page. That is, the intra-engine controller functions as a paper thickness calculator.

After finishing the step in S713 or S715, the intra-engine controller determines whether or not it has already finished carrying all pages in the current job in S714. If it has already finished carrying all pages (YES in S714), the process ends. Alternatively, if it has not finished carrying all pages yet, the process goes back to S708, and the steps are repeated from the next "paper present" timing shown in FIG. 5. By performing the process described above, the paper thickness detecting operation in this embodiment finishes.

As described above, the image forming apparatus in this embodiment can detect vibration due to disturbance in the paper thickness detecting operation using the paper thickness detection roller 108. In addition, as described above with reference to FIG. 7, since the image forming apparatus cancels the paper thickness detecting operation in case of detecting the disturbance, it is possible to prevent detecting incorrect paper thickness.

In addition, since the image forming apparatus in this embodiment can also detect vibration due to disturbance by using the sensor for detecting paper thickness without including additional modules such as a vibration detection sensor and an acceleration sensor, it is possible to detect disturbance by using the uncomplicated configuration without increasing the apparatus cost.

In this embodiment, as shown in FIG. 6, the case in which the vibration close to the frequency component defined by the rotation period of the supporting roller 108*a* and the driven roller 108*b* was described as an example. However, in some cases, disturbance may cause vibration with completely different frequency component. For example, in case of a normal driven detection signal shown in FIG. 8A with disturbance vibration shown in FIG. 8B, the driven detection signal becomes a waveform shown in FIG. 8C.

Figure 8A:
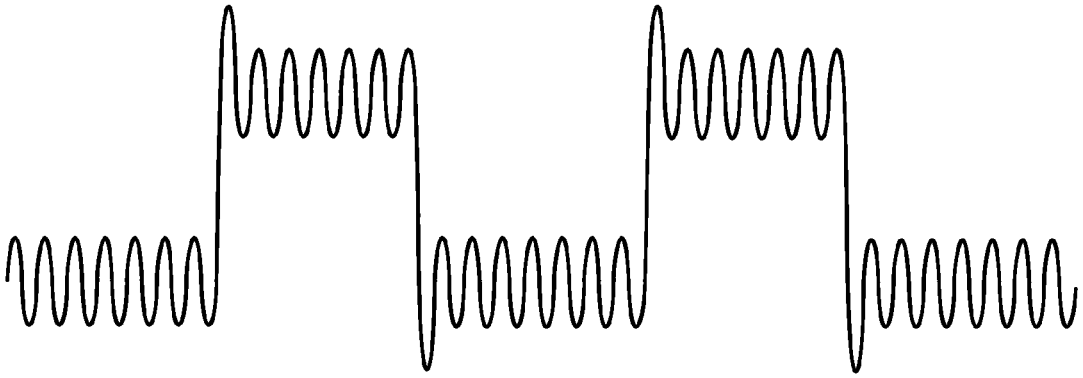
FIGS. 8A, 8B, and 8C are diagrams illustrating disturbances.
Figure 8B:
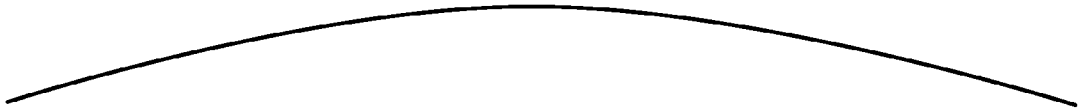
Figure 9:
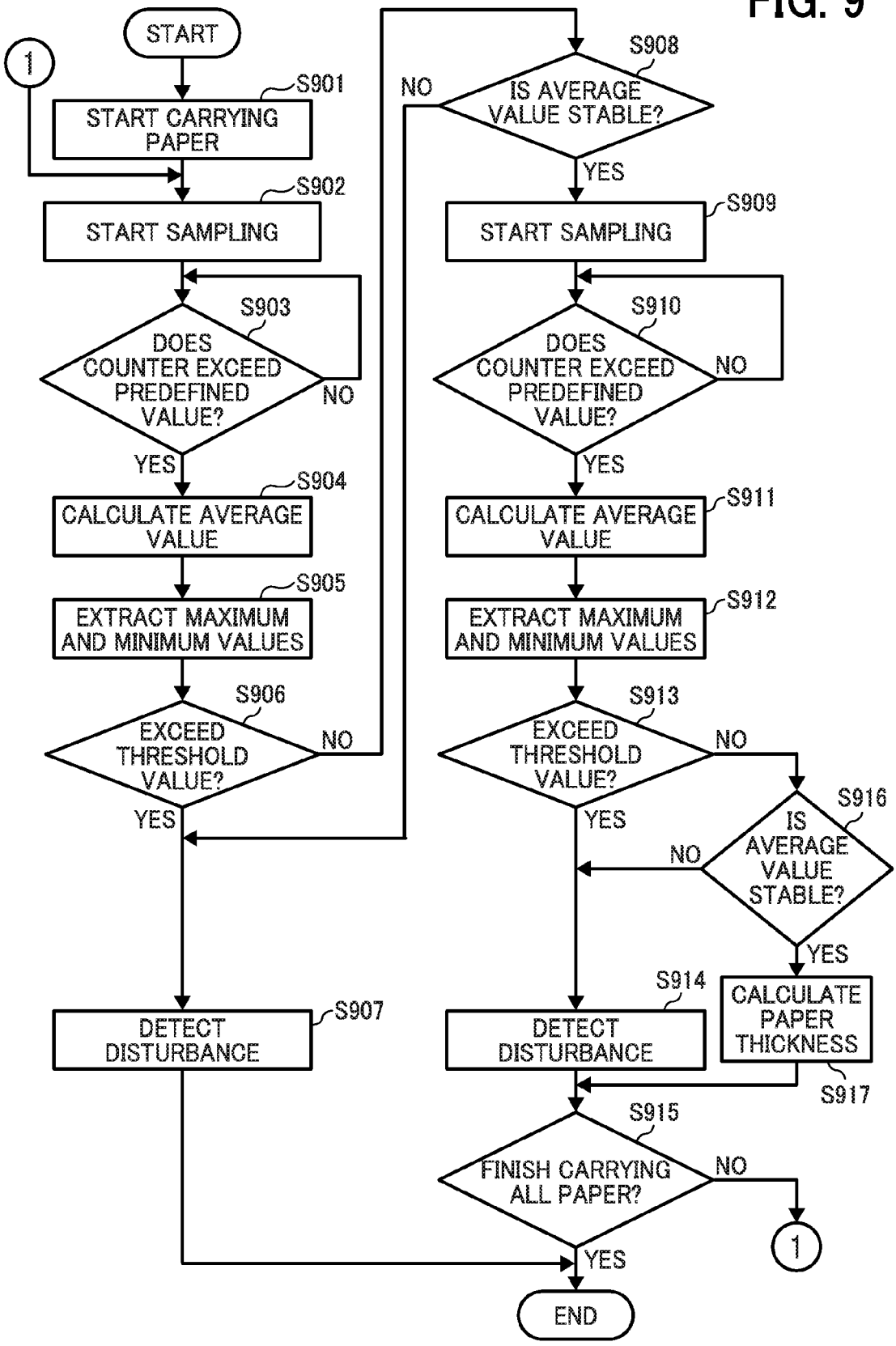
FIG. 9 is a flowchart illustrating a process of detecting paper thickness.

In case of the moderate vibration shown in FIG. 8B, it is difficult to detect occurring disturbance by determining the maximum and minimum values in each "paper present" and "no paper" period. An example case in which such disturbance can be detected is described below with reference to FIG. 9. FIG. 9 is a flowchart illustrating a process of detecting paper thickness that includes a disturbance detecting process that can detect the disturbance shown in FIG. 8B.

As shown in FIG. 9, the steps from S901 to S907 are the same as the steps from S701 to S707 in FIG. 7. After determining in S906, if the maximum and minimum values fall within the predetermined threshold values (NO in S906), the intra-engine controller determines whether or not the average calculated in S904 is stable in S908.

In S908, after comparing the average calculated in previous "no paper" period with the average calculated in S904 this time, it is determined whether or not the difference between those averages falls within predetermined range. In other words, in S908, the latest calculated average among averages calculated for repeated "no paper" periods is compared with the average calculated previously. Consequently, in case of occurring the disturbance vibration shown in FIG. 8B and the driven detection signal becomes the waveform shown in FIG. 8C, it is possible to determine disturbance by detecting that the average itself is changing.

In S908, other than comparing with the previous average, it is also possible to determine whether or not the average calculated in S904 falls within predetermined standard value range. In addition, in case of comparing with the previous average, it is possible to omit the step in S908 if it is the first "no paper" period in that job and there is no previous average.

After determining in S908, if it is determined that the average is not stable, that is, the difference from the previous average exceeds the predetermined threshold value (NO in S908), the intra-engine controller proceeds to a disturbance detecting operation in S907. Alternatively, if it is determined that the average is stable (YES in S908), the intra-engine controller proceeds to the steps after S909. The steps from S909 to S914 are the same as the steps from S708 to S713 in FIG. 7.

After determining in S913, if the maximum and minimum values fall within the predetermined threshold values (NO in S706), the intra-engine controller determines whether or not the average calculated in S911 is stable in S916 just like in S908. In S916, after comparing the average calculated in previous "paper present" period with the average calculated in S911 this time, the intra-engine controller determines whether or not the difference between those averages falls within predetermined range. In other words, in S916, the latest calculated average among averages calculated for repeated "paper present" periods is compared with the average calculated previously.

Figure 8C:
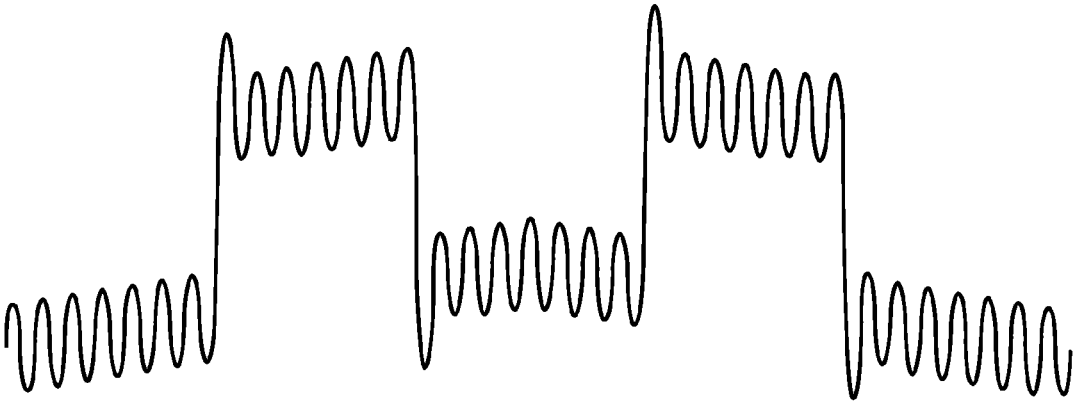

Consequently, just like in S908, in case of occurring the disturbance vibration shown in FIG. 8B and the driven detection signal becomes the waveform shown in FIG. 8C, it is possible to determine disturbance by detecting that the average itself is changing. In addition, just like in S908, it is possible to omit the step in S916 if it is the first "paper present" period in that job and there is no previous average.

After determining in S916, if it is determined that the average is not stable, that is, the difference from the previous average exceeds the predetermined threshold value (NO in S916), the intra-engine controller proceeds to the disturbance detecting operation in S914. Alternatively, if it is determined that the average is stable (YES in S916), the intra-engine controller calculates the paper thickness of the page by subtracting the average calculated in S904 from the average calculated in S911 in S917. Consequently, the intra-engine controller acquires the paper thickness of the page.

After finishing the step in S914 or S917, the intra-engine controller determines whether or not it has already finished carrying all pages in the current job in S915. If it has already finished carrying all pages (YES in S915), the process ends. Alternatively, if it has not finished carrying all pages yet, the process goes back to S902, and the steps are repeated from the next "no paper" timing shown in FIG. 5.

In the case shown in FIG. 7, after calculating the average during the "no paper" period once, it is possible to repeat calculating the average during the "paper present" period only. However, in the case shown in FIG. 9, since it is necessary to compare with the previous calculated average, the process goes back to S902, and the average during the "no paper" period is also calculated. That is, the intra-engine controller calculates the average and detects vibration for each "paper present" and "no paper" period alternately repeated in accordance with carrying multiple papers sequentially carried. It should be noted that it is possible that the process goes back to S702 from S714 in FIG. 7. Consequently, it is also possible to detect disturbance after the second "no paper" period.

As shown in FIG. 9, by determining whether or not the average calculated for each repeated "no paper" and "paper present" period falls within normal value, it is possible to detect disturbance undetectable by determining the maximum and minimum values.

Figure 10:
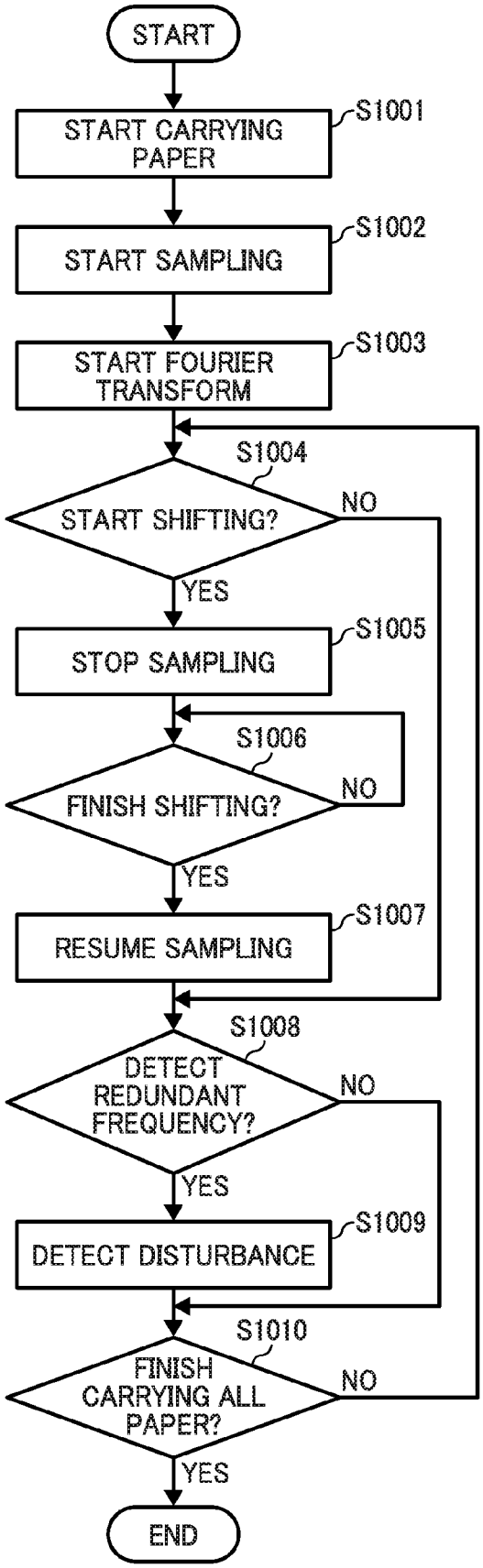
FIG. 10 is a flowchart illustrating a process of detecting disturbance by frequency analysis.

Other than determining the driven detection signal directly as shown in FIGS. 7 and 9, it is also possible to detect disturbance by using frequency analysis of the driven detection signal. A case using frequency analysis of the driven detection signal is described below with reference to FIG. 10. As shown in FIG. 10, after starting carrying paper from the paper feed table 25 in S1001, the intra-engine controller starts sampling the driven detection signal in S1002 just like in FIGS. 7 and 9 and furthermore starts calculating Fourier transform on the sampled values in real time in S1003.

Figure 11A:
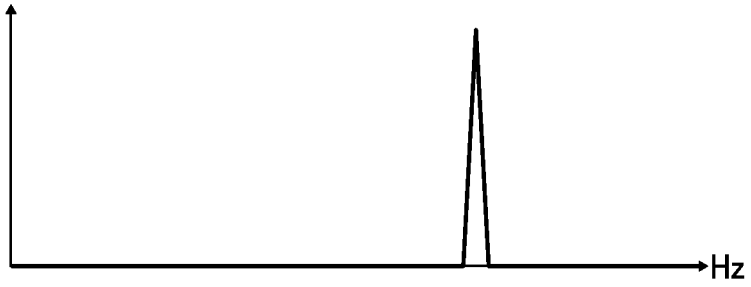
FIGS. 11A, 11B, and 11C are diagrams illustrating the frequency analysis shown in FIG. 10.
Figure 11B:
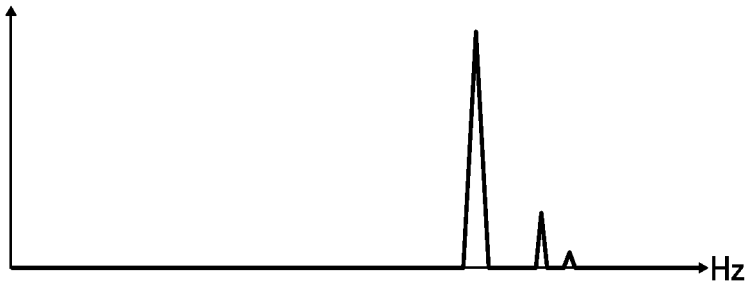
Figure 11C:
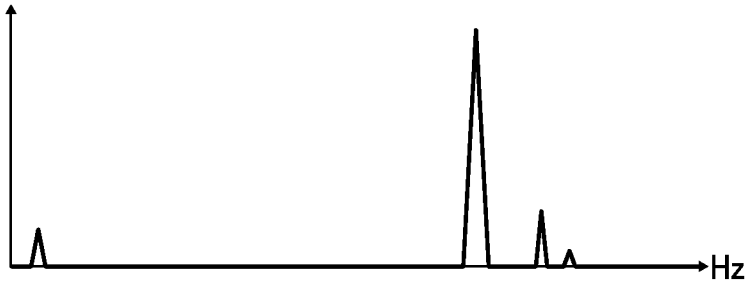

In the case shown in FIG. 10, the intra-engine controller performs Fourier transform with reference to the latest value in predetermined period among the sampled driven detection signal values. Consequently, the frequency component of the driven detection signal can be extracted. FIGS. 11A, 11B, and 11C are diagrams illustrating the extracted frequency component.

FIG. 11A is a diagram illustrating frequency component in case of the normal waveform as shown in FIG. 8A. As shown in FIG. 11A, in case of not occurring disturbance, only frequency component defined by rotation period of the supporting roller 108*a* and the driven roller 108*b* is extracted. FIG. 11B is a diagram illustrating frequency component in case of occurring disturbance as shown in FIG. 6. FIG. 11C is a diagram illustrating frequency component in case of occurring disturbance as shown in FIG. 8C. As shown in FIG. 11B and 11C, in case of occurring disturbance, frequency component of the disturbance is extracted in addition to frequency component defined by rotation period of the supporting roller 108*a* and the driven roller 108*b*.

After starting Fourier transform, at the timing of starting shifting based on each period and the count value for determining shift timing as shown in FIG. 5 (YES in S1004), the intra-engine controller stops sampling the driven detection signal in S1005. After finishing shifting (YES in S1006), the intra-engine controller resumes sampling in S1007. Consequently, it is possible to prevent detecting a signal in shifting as redundant frequency component.

By extracting the frequency component of the driven detection signal in real time performing Fourier transform, the intra-engine controller can determine whether or not frequency component other than defined by rotation period of the supporting roller 108*a* and the driven roller 108*b*, that is, redundant frequency component exists as shown in FIG. 11B. If such redundant frequency is detected (YES in S1008), the intra-engine controller performs the disturbance detecting operation in S1009 just like in FIGS. 7 and 8.

Subsequently, the steps from S1004 are repeated until finishing carrying all pages in the current job. In case of finishing carrying all pages (NO in S1010), the process ends. Consequently, the disturbance detecting operation using frequency analysis ends.

In the case shown in FIG. 10, in addition to detecting the moderate disturbance as shown in FIG. 8, it is possible to detect high-frequency disturbance that does not affect the average, maximum, and minimum values of the driven detection signal.

As described above, in the image forming apparatus in this embodiment, it is possible to detect disturbance by using the uncomplicated configuration and reducing the apparatus cost without including special modules such as the vibration detection sensor etc. In addition, in detecting paper thickness, by canceling the calculation of the paper thickness in case of detecting disturbance, it is possible to prevent calculating incorrect paper thickness.

In the embodiment described above, operations shown in FIGS. 7, 9, and 10 etc. are realized by the intra-engine controller in the print engine 26. This is just an example, and those operations can be executed by the controller 20. In that case, the same operation as described above can be realized by inputting the detection signal of the driven detection sensor 108*c* into the controller 20. In addition, the average is calculated in S704 and S710 in FIG. 7 etc. This is just an example too, and median value and mode value can be used for that purpose.

Numerous additional modifications and variations are possible in light of the above teachings. It is therefore to be understood that, within the scope of the appended claims, the disclosure of this patent specification may be practiced otherwise than as specifically described herein.

As can be appreciated by those skilled in the computer arts, this invention may be implemented as convenient using a conventional general-purpose digital computer programmed according to the teachings of the present specification. Appropriate software coding can readily be prepared by skilled programmers based on the teachings of the present disclosure, as will be apparent to those skilled in the software arts. The present invention may also be implemented by the preparation of application-specific integrated circuits or by interconnecting an appropriate network of conventional component circuits, as will be readily apparent to those skilled in the relevant art.

Each of the functions of the described embodiments may be implemented by one or more processing circuits. A processing circuit includes a programmed processor, as a processor includes circuitry. A processing circuit also includes devices such as an application specific integrated circuit (ASIC) and conventional circuit components arranged to perform the recited functions.

What is claimed is:

1. A control apparatus for an image forming apparatus that forms and outputs an image on a recording sheet, the image forming apparatus including a pair of rollers that sandwich the recording sheet, the center of an axle of at least one of the rollers being displaceable, the control apparatus comprising:

a roller position detector configured to generate an output signal based on a position of the displaceable roller;

a roller position detection signal acquisition unit configured to acquire multiple detection signals in chronological order based on the output signal;

a recording sheet thickness detector configured to detect recording sheet thickness based on the output signal by calculating a first value based on the multiple detection signals acquired while the recording sheet goes through the pair of rollers, and calculating a second value based on the multiple detection signals acquired while the pair of rollers do not sandwich the recording sheet after the image forming apparatus starts carrying the recording sheet;

a vibration detector configured to detect unusual vibration of the image forming apparatus based on both the first value and the second value, wherein the recording sheet thickness detector is configured to cancel detection of the recording sheet thickness if the vibration detector detects the unusual vibration.

2. The control apparatus according to claim 1, wherein the vibration detector is configured to detect the unusual vibration of the image forming apparatus when a difference between minimum and maximum values among the multiple detection signals exceeds a threshold value.

3. The control apparatus according to claim 2, wherein the threshold value is determined by eccentricity of the pair of rollers.

4. The control apparatus according to claim 1, wherein the vibration detector is configured to, alternately acquire either an average of the multiple detection signals acquired while the recording sheet goes through the pair of rollers or an average of the multiple detection signals acquired while the pair of rollers do not sandwich the recording sheet, for a plurality of recording sheets being sequentially transferred, and detect vibration of the image forming apparatus based on a result of comparing the latest average of the multiple detection signals with the previous averages of the multiple detection signals.

5. The control apparatus according to claim 1, wherein the vibration detector is configured to extract a frequency component of the multiple detection signals acquired in chronological order and detect vibration based on a result of extracting the frequency component.

6. An image forming apparatus, comprising the control apparatus for forming an image according to claim 1.

7. The control apparatus for of claim 1, wherein the roller position detection signal acquisition unit is configured to acquire the multiple detection signals by, sampling the multiple detection signals during a first sampling time period to determine a first period and a second period, the first period being a period in which the recording sheet is sandwiched by the pair of rollers, the second period being a period in which the recording sheet is not sandwiched by the pair of rollers, shifting a sampling time period based on the determined first period and the determined second period, and sampling the multiple detection signals during a second sampling time period using the shifted sampling time period.

8. A method of controlling an image forming apparatus that forms and outputs an image on a recording sheet, the method comprising:

generating an output signal based on a position of an axially displaceable roller of the image forming apparatus;

acquiring multiple detection signals in chronological order based on the output signal, the multiple detection signals indicating the position of the axially displaceable roller;

detecting recording sheet thickness based on the output signal by calculating a first value based on the multiple detection signals acquired while the recording sheet goes through the pair of rollers, and calculating a second value based on the multiple detection signals acquired while the pair of rollers do not sandwich the recording sheet after the image forming apparatus starts carrying the recording sheet;

detecting unusual vibration of the image forming apparatus based on both the first value and the second value; and cancelling the detecting of the recording sheet thickness if the unusual vibration is detected.

9. A non-transitory recording medium storing a program that, when executed by a computer, causes a processor to implement a method of controlling an image forming apparatus that forms and outputs an image on a recording sheet, the method of controlling the image forming apparatus comprising :

generating an output signal based on a position of an axially displaceable roller of the image forming apparatus;

acquiring multiple detection signals in chronological order based on the output signal;

detecting recording sheet thickness based on the output signal by calculating a first value based on the multiple detection signals acquired while the recording sheet goes through the pair of rollers, and calculating a second value based on the multiple detection signals acquired while the pair of rollers do not sandwich the recording sheet after the image forming apparatus starts carrying the recording sheet;

detecting unusual vibration of the image forming apparatus based on both the first value and the second value; and cancelling the detecting of the recording sheet thickness if the unusual vibration is detected.

10. A control apparatus for an image forming apparatus that forms and outputs an image on a recording sheet, the image forming apparatus including a pair of rollers that sandwich the recording sheet, the center of an axle of at least one of the rollers being displaceable, the control apparatus comprising:

a roller position detector configured to generate multiple detection signals indicating positions of the displaceable roller;

a roller position detection signal acquisition unit configured to acquire the multiple detection signals in chronological order;

a recording sheet thickness calculator configured to calculate recording sheet thickness based on the multiple detection signals acquired in chronological order; and a vibration detector configured to detect vibration of the image forming apparatus based on the multiple detection signals acquired in chronological order, wherein, the recording sheet thickness calculator is configured to selectively calculate recording sheet thickness by calculating a difference between a first value calculated based on the multiple detection signals acquired while the recording sheet goes through the pair of rollers and a second value calculated based on the multiple detection signals acquired while the pair of rollers do not sandwich the recording sheet after the image forming apparatus starts carrying the recording sheet, the vibration detector is configured to detect vibration of the apparatus based on both the first value and the second value, the recording sheet thickness calculator is configured to cancel calculating recording sheet thickness for a period while the recording sheet goes through the pair of rollers in case the vibration detector detects vibration of the image forming apparatus by the first value calculated based on the multiple detection signals acquired during the period, and the vibration detector is configured to, alternately acquire either an average of the multiple detection signals acquired while the recording sheet goes through the pair of rollers or an average of the multiple detection signals acquired while the pair of rollers do not sandwich the recording sheet, for a plurality of recording sheets being sequentially transferred, detect vibration of the image forming apparatus based on a result of comparing the latest average of the multiple detection signals acquired while the recording sheet goes through the pair of rollers with the previous averages of the multiple detection signals acquired while the recording sheet goes through the pair of rollers, and detect vibration of the image forming apparatus based on a result of comparing the latest average of the multiple detection signals acquired while the pair of rollers do not sandwich the recording sheet with the previous averages of the multiple detection signals acquired while the pair of rollers do not sandwich the recording sheet.

* * * * *